US006309087B1

(12) United States Patent
Huang

(10) Patent No.: US 6,309,087 B1
(45) Date of Patent: Oct. 30, 2001

(54) NET LIGHT SET WITH ICE STICK SECTION

(75) Inventor: Peter K. H. Huang, Taipei (TW)

(73) Assignee: Shining Blick Enterprises Co., Ltd., Taipei (TW)

( * ) Notice: Subject to any disclaimer, the term of this patent is extended or adjusted under 35 U.S.C. 154(b) by 0 days.

(21) Appl. No.: 09/453,574

(22) Filed: Dec. 2, 1999

(30) Foreign Application Priority Data

Nov. 18, 1999 (CN) ..... 99-2-54240

(51) Int. Cl.[7] ..... F21S 4/00

(52) U.S. Cl. ..... 362/252; 362/249; 362/391; 362/806; D26/25

(58) Field of Search ..... 362/252, 249, 362/391, 806; D26/25

(56) References Cited

U.S. PATENT DOCUMENTS 5,967,644 * 10/1999 Pan ..... 362/249
6,106,138 * 8/2000 Wei ..... 362/252
6,152,576 * 11/2000 Mount ..... 362/252
6,190,021 * 2/2001 Huang ..... 362/227
6,217,193 * 4/2001 Won ..... 362/249
6,224,239 * 5/2001 Adler ..... 362/249

* cited by examiner

*Primary Examiner*—Stephen Husar
*Assistant Examiner*—Anabel Ton
(74) *Attorney, Agent, or Firm*—Dougherty & Troxell

(57) ABSTRACT

A net light set, with an ice stick section, capable of giving an effect of illumination and flashing of a netted lamp section and the ice stick section, the net light set is composed of one or more than one lamp strings. The lamp strings are bent when in braiding into bending sections having mutually neighboring conductor sections, the upper portions thereof in a predetermined height above a level line are braided into the netted lamp section, while the lower portions thereof with different lengths below said level line are left and treated as the ice stick section.

4 Claims, 8 Drawing Sheets

NET LIGHT SET WITH ICE STICK SECTION

BACKGROUND OF THE INVENTION

1. Field of the Invention

The present invention is related to a net light set with an ice stick section, and especially to a decorative light set with a depending ice stick section.

2. Description of the Prior Art

In a conventional decorative light, lamp bulbs are serially connected to a pair of conductors, and are connected with an electric power source through a power conductor; therefore, the whole lamp string can illuminate and flash for a decorative effect. Such a conventional lamp string not only is monotonic, but also is bothersome and inconvenient in taking down for storing after use if it has been wrapped on an object such as a Christmas tree.

Thereby, designs of various net light sets have been proposed in recent years. These designs mainly have decorative lights formed in net shapes; all lamp bulbs and conductors can be conveniently draped over an object to be decorated (such as a Christmas tree). In addition to fast draping over the object to be decorated, a net light set can be taken down for storing when not in use. Such net light sets include those claimed in Dorfman's U.S. Pat. No. 5,213,519, U.S. Pat. No. 5,424,925 granted to Jenke et al., and the applicant's U.S. Pat. No. 5,663,409. Wherein, Dorfman's patent has the intercrossing net lines (i.e., conductors) extended through a receptacle from the upper or lower area thereof respectively; this mode makes the structures of the receptacle complicated. The patent of Jenke et al. has the intercrossing net lines extended through an additional connector. The U.S. Pat. No. 5,662,409 is somewhat different, it uses a conventional receptacle at the intercrossing point of net lines and with additional engaging members to position conductors; and then the lines are pulled to form the shape of a net.

In recent years, such net light sets even avoided the limitation of only hanging on a spot for decoration. A whole net light set can be braided with a plurality of lamp strings to form a more decorative product. These braided lamp strings can be received individually in the interior of a control box; an IC is used to control turning on/off and flashing of the lamp strings. Thereby, the entire braided lamp can be constructed into various static and dynamic illuminating and flashing patterns; its decorative effect is more variant and attractive.

Another type of decorative light used in festivals is a lamp with an ice stick section, wherein, an upper transverse main conductor is provided for positioning of the lamp on the upper edge of a window. The transverse main conductor is provided thereon with spaced lamp strings of various lengths. Lamp bulbs on these long and short lamp strings will look like ice sticks or icicles attached to the window surface when the lamp bulbs are turned on.

The aforesaid net light sets and lights with an ice stick section are separately produced, i.e., they are produced in factories in different lines of production.

SUMMARY OF THE INVENTION

The object of the present invention is to provide a net light set with an ice stick sections. Lamps forming an ice stick section are left at the lower end of the network; thereby, the decorative effect thereof is further improved.

To obtain the object, the present invention is formed from a plurality of lamp strings forming a net with a lower end of the net having spaced apart depending strips of different lengths. The receptacles in the upper areas of the net have conductors fixed thereon, and a net light set thus is formed. The receptacles at the lower end of the net can have the residual lengths of the lamp strings depending therefrom to be used as an ice stick section.

The lamp strings are made in different lengths and bent when braided, the upper portions thereof above a predetermined level line are braided into a net, while the lower portions thereof with different lengths are left and used as an ice stick section.

The depending lengths in the whole light set formed from a plurality of lamp strings can belong to part of the lamp strings, or can be formed from other separated lamp strings braided in the net light set.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
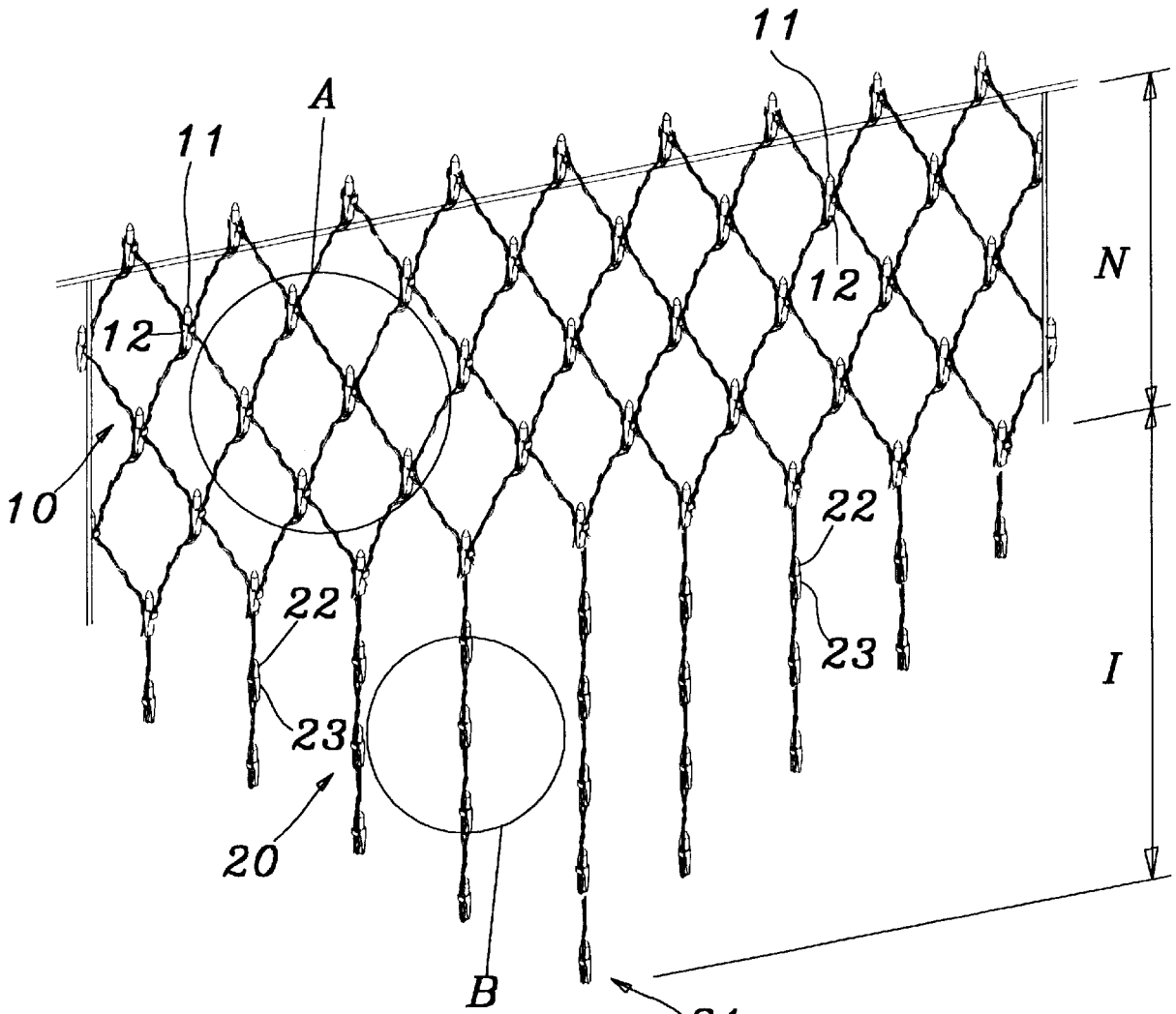
FIG. 1 is a perspective view showing a preferred embodiment of the present invention.

Referring to FIG. 1, when the whole decorative light set of the present invention is shaped, it is a net light set 10 with a height N and with a lower extending portion of the net including an ice stick section 20 (with a height 1). In this embodiment, the middle strip of the ice stick section 20 has the longest pending length, lengths of the other strips at both sides thereof are gradually reduced, thereby forming a lower portion of the decorative light set in the shape of "V". However, these lengths can be randomly chosen to form ice stick sections in various fashions. For example, the lengths of the pending strips of the ice stick section 20 can be gradually reduced sideways from the middle to form a lower portion of the decorative light set in the inversed shape of "V".

The abovementioned net light set 10 has lamp bulbs 11 and receptacles 12 thereof located at the intercrossing points of the netting lines. While the ice stick section 20 simply has lamp bulbs 22 and receptacles 23 thereof together with conductors thereon depending in straight lines.

Figure 2:
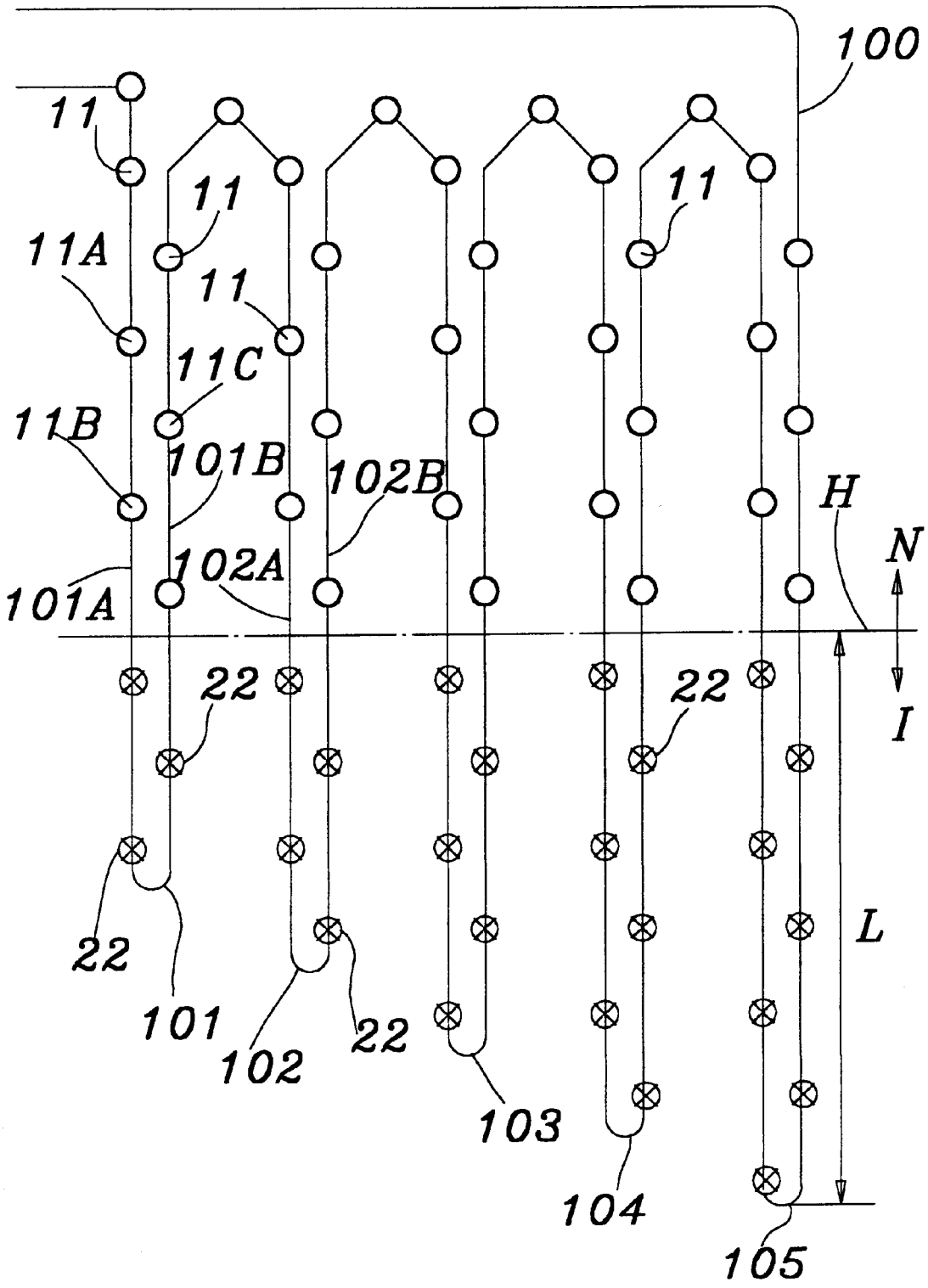
FIG. 2 is an enlarged schematic view showing the bending state of the lamp strings on the left half portion of FIG. 1 before shaping of the lamp strings.

Referring particularly to FIG. 2 now for description, the lamp string shown therein strings the abovementioned lamp bulbs 11, 22 in a pair of conductors and then the pair of conductors are bent into sections of various lengths. In using [on] the embodiment shown in FIG. 1, a first bending section 101, a second bending section 102, a third bending section 103, a fourth bending section 104 and a fifth bending section 105 are provided with their lengths being gradually longer toward the middle bending section 105 in FIG. 2.

The bending sections 101, 102, 103, 104 and 105 each include two mutually neighboring conductor sections. For example, the first bending section 101 includes the first conductor section 101A and the second conductor section 101B. Each conductor section 101A, 101B includes a plurality of lamp bulbs 11, 22. The lamp bulbs 11, 22 on the mutually neighboring conductor sections 101A, 101B are alternately arranged relative to each other. The first conductor section 101A has thereon a lamp bulb 11A and a lamp bulb 11B, while the second conductor section 101B has thereon a lamp bulb 11C arranged at a position between the lamp bulbs 11A and 11B. In this way, lamp bulbs on the conductor sections 101A, 101B are arranged in an alternate way, the net light set and the ice stick section are to be formed based on this arrangement.

The lamp strings of the present invention are to be formed into a netted lamp section with a predetermined height, the conductors and lamp bulbs thereunder are to be formed into an ice stick section. Taking a level line H shown in FIG. 2 as an example, the area above the level line H is the netted lamp section N, while the area below it is the ice stick section 1. The abovementioned bending sections 101, 102, 103, 104 and 105 leave their respective pending sections below the level line H (for example, length of the pending section of the fifth bending section 105 is L), such length of the pending sections can be chosen optionally. Each bending section can keep a different length chosen depending on the type of the ice stick section to be formed. Thereby, types of the net light sets with ice stick sections of the present invention can be various.

Figure 3:
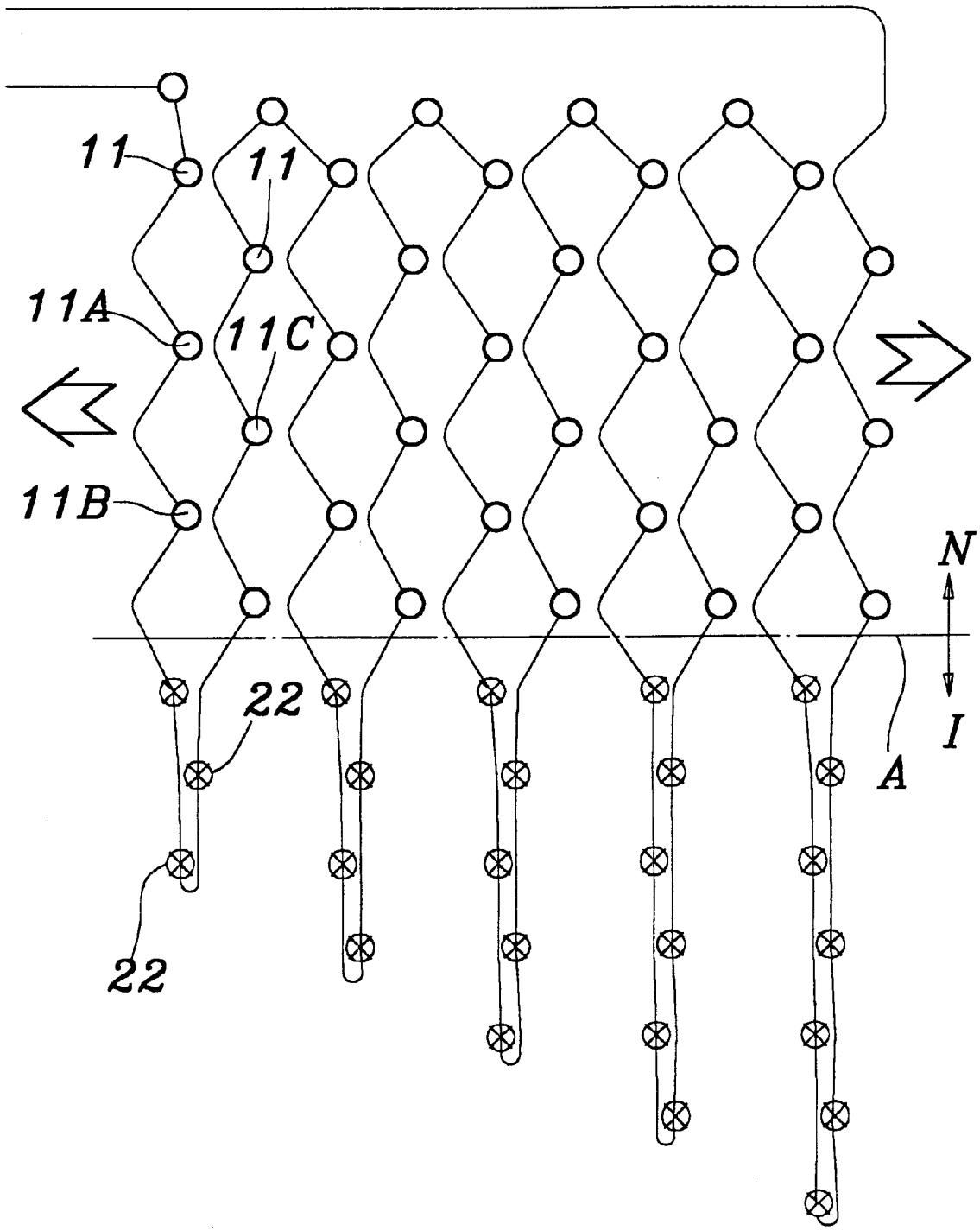
FIG. 3 is a schematic view showing shaping of the lamp strings of FIG. 2.

As shown in FIG. 3, the bending sections above the abovementioned level line H can have their respective pairs of conductor sections positioned on the lamp bulb receptacles arranged at alternate positions, and then are pulled to stretch and form the netted lamp section as shown by the arrows in the drawing. While the bending sections below the level line H can be connected with the pending lamp strings to form an ice stick section.

Figure 4:
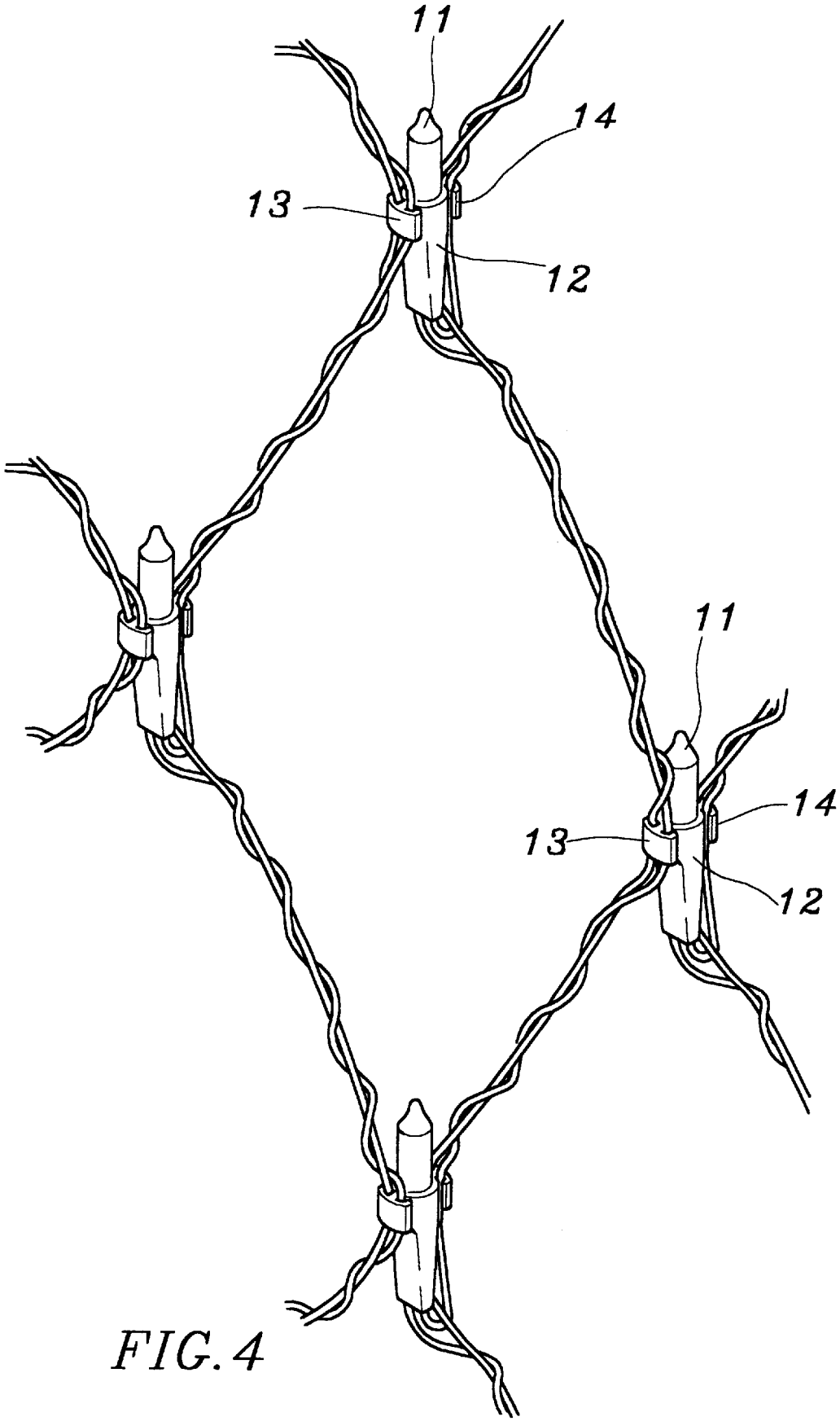
FIG. 4 is an enlarged view showing in detail an upper net area A of FIG. 1.
Figure 5:
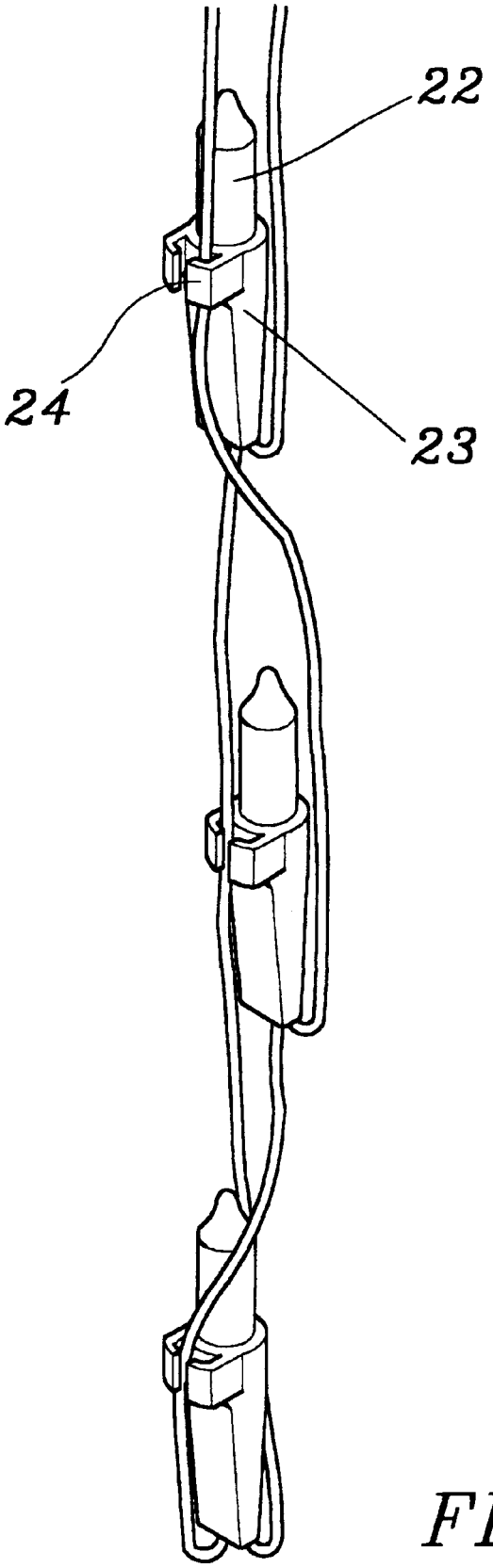
FIG. 5 is an enlarged view showing in detail a lower lamp group B with an ice stick section of FIG. 1.

FIG. 4 shows a receptacle 12 especially suitable for the upper netted lamp section of the present invention. The receptacle 12, in addition to being used for insertion of a lamp bulb thereon and extending therefrom a pair of conductors, can be integrally formed on the exterior periphery thereof with wings 13, 14 for clamping and positioning the aforesaid mutually neighboring conductor sections. The lower ice stick section can take advantage of such a receptacle 23 shown in FIG. 5, but the receptacle 23 is preferably only has a single wing 24 to make the conductors get close to each other to form a strip like line.

Figure 6:
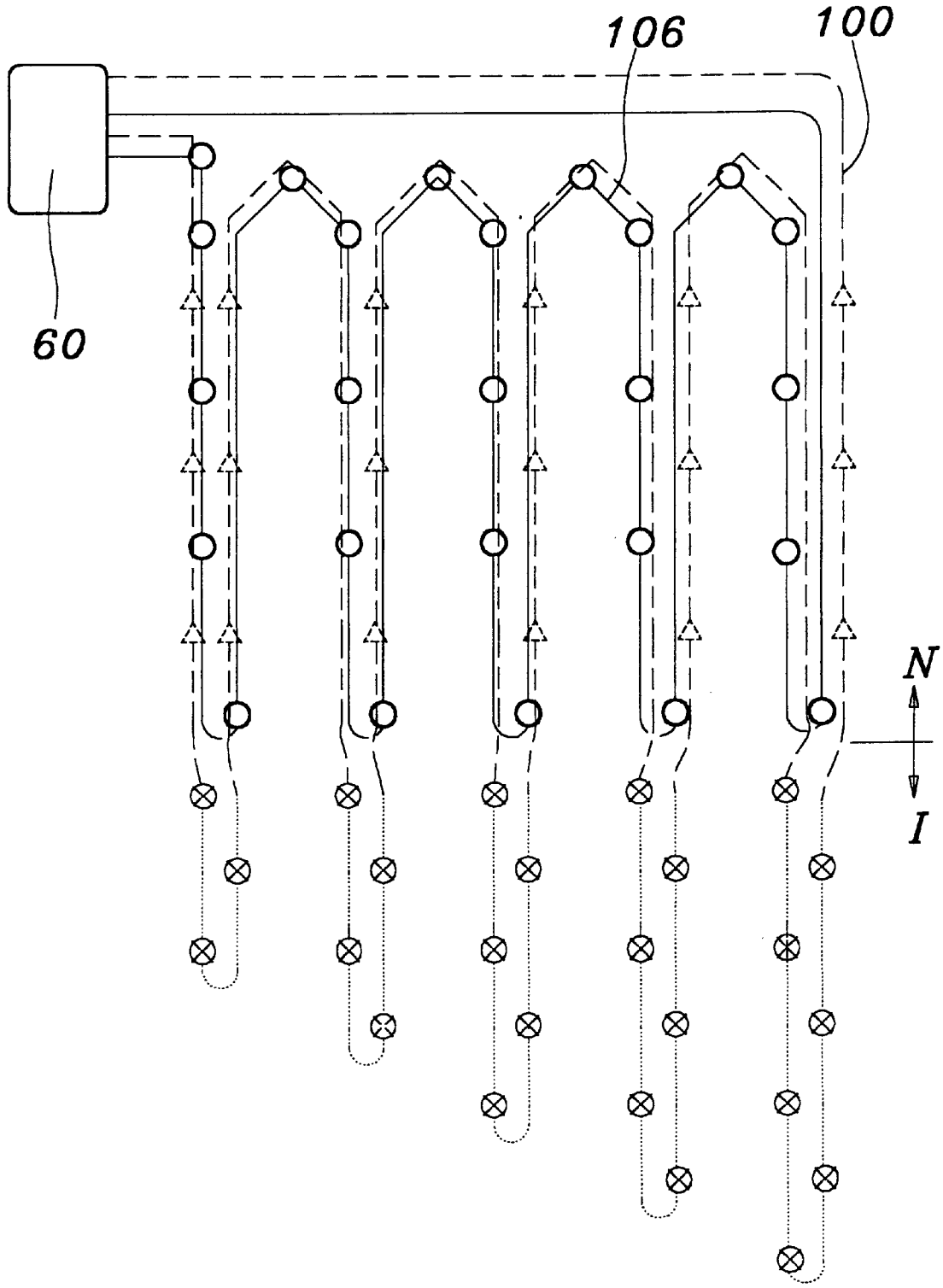
FIG. 6 is a schematic view showing braiding of two lamp strings of the present invention.

To get better illumination and flashing function, the decorative light set of the present invention can be composed of a plurality of lamp strings. As shown in FIG. 6, it is composed of two lamp strings, including a lamp string 100 identical to the one stated above and indicated by a dash line, and including another main lamp string 106 of the net light set indicated by a solid line. The conductors of these lamp strings 100, 106 are connected to a control box 60; while illumination and flashing of the whole decorative light set are controlled by an internal IC. In this embodiment, the upper sections of the lamp string 100 and the main lamp string 106 are braided into the desired netted lamp section N; the lower section of the lamp string 100 below the level line can similarly form an ice stick sections I.

Figure 7:
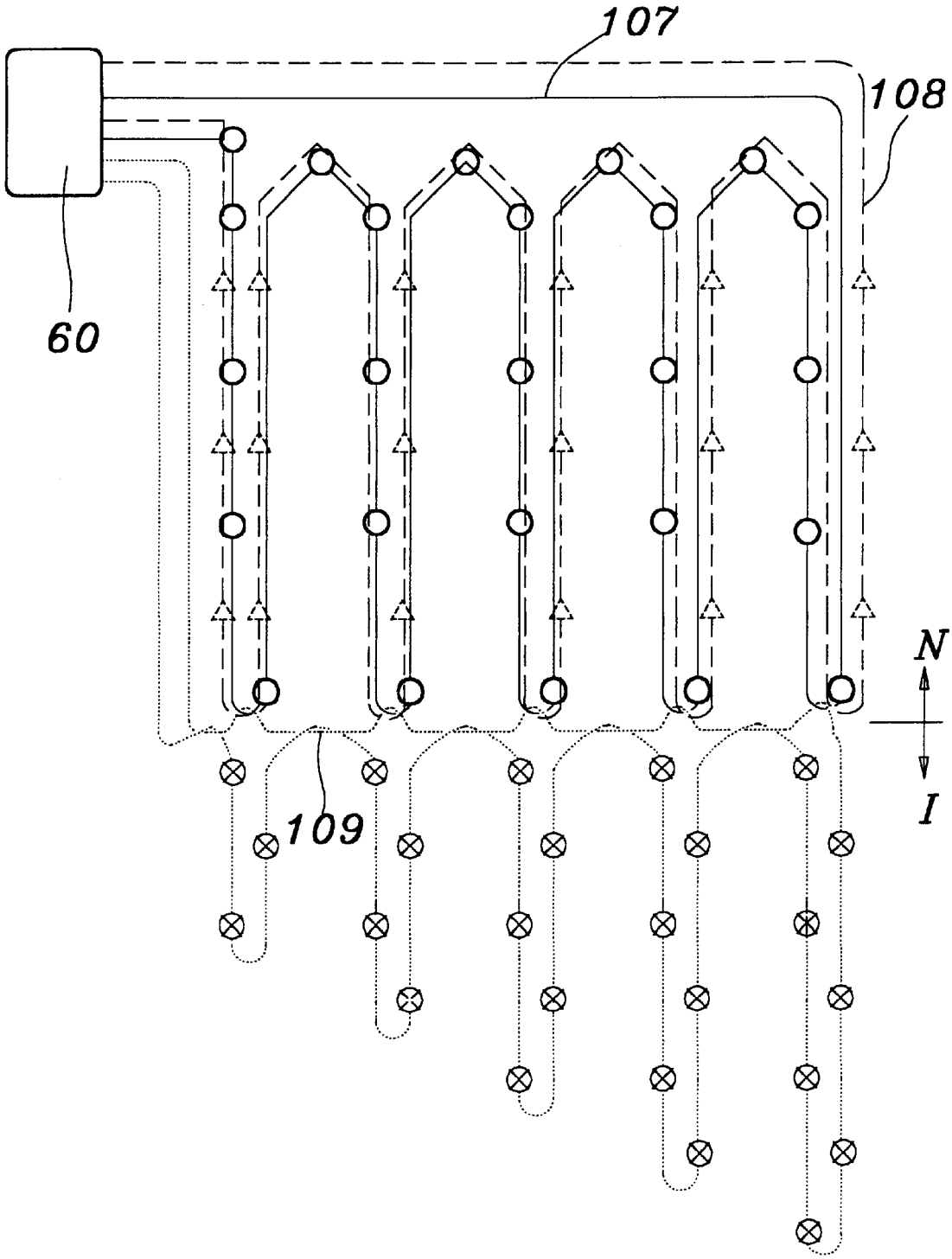
FIG. 7 is a schematic view showing braiding of three lamp strings of the present invention.
Figure 8:
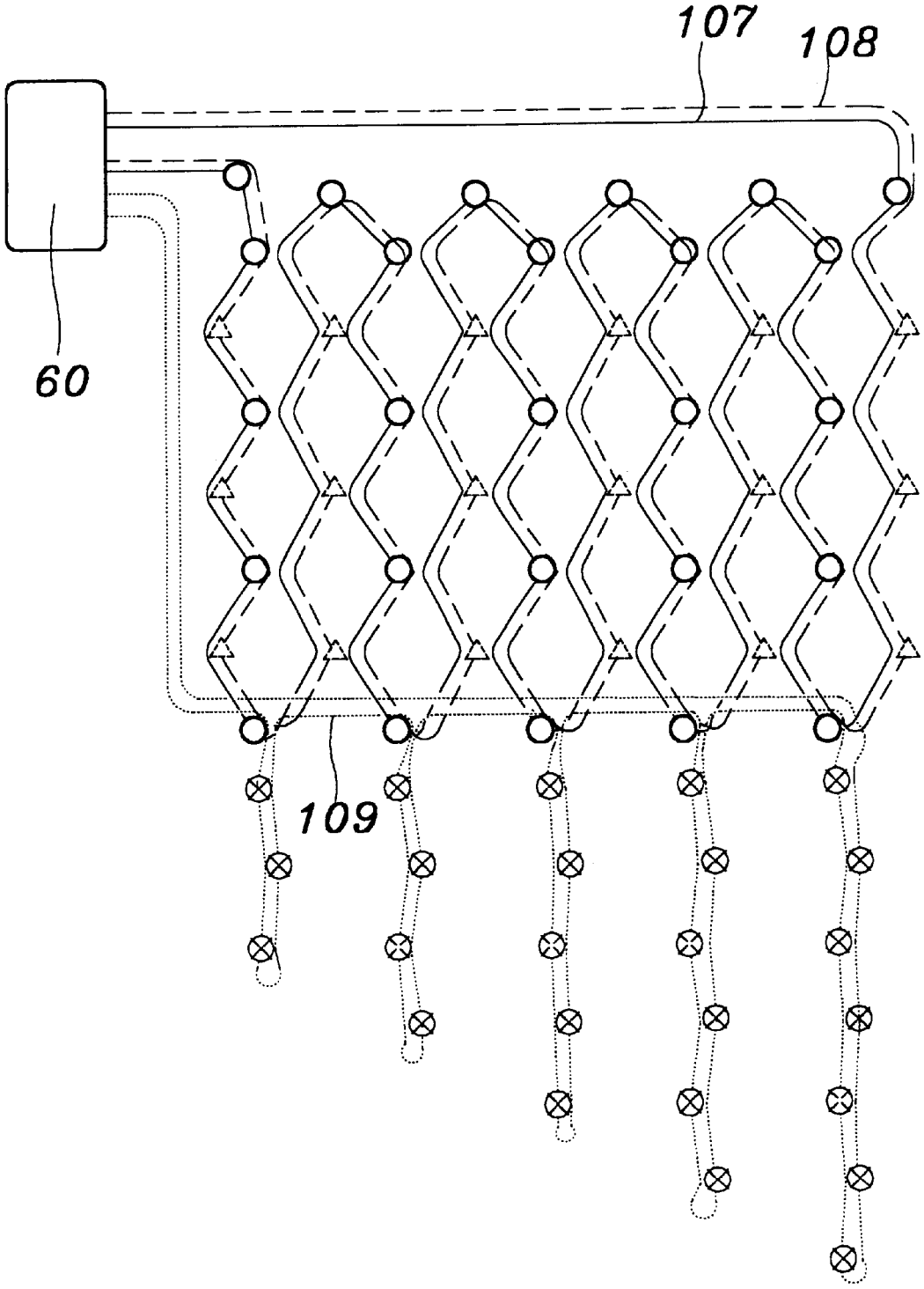
FIG. 8 is a schematic view showing shaping of the lamp strings of FIG. 7.

In another embodiment shown in FIGS. 7 and 8, the decorative light set of the present invention is composed of a first lamp string 107 shown with a solid line, a second lamp string 108 shown with a dash line, and a third lamp string 109 shown with a dotted line. The lamp strings 107, 108, 109 are also connected to a control box 60. The lamp strings 107, 108, 109 are together braided into the desired upper netted lamp section, the lamp string 109 singly or together with other lamp strings forms the main lamp strings separately driving and controlling the an ice stick sections. Such net light set with the ice stick section composed of a plurality of lamp strings can make various static and dynamic illuminating and flashing function under control of the control box 60. And the main lamp strings for controlling the netted lamp section or the ice stick section can include more than one lamp strings to optionally make illumination and flashing of the netted lamp section or the ice stick section. Thereby for example, the netted lamp section can have various types of dynamic patterns, and the lamp bulbs of the ice stick section can be set to flash alternately from the uppermost ones to the bottommost ones, so that imitation of dropping of ice drops can be made.

The present invention can form together an ice stick section below the upper netted lamp section with more than one lamp strings, this not only allows convenient production of the innovate combined decorative light set in an identical production procedure as that used before, but also makes such net light set be innovative and marvelous in its decorative function.

The embodiments stated above is only for illustrating a preferred embodiment of the present invention, and not for giving any limitation to the scope of the present invention. It will be apparent to those skilled in this art that various modifications or changes can be made to the elements of the present invention without departing from the spirit, and scope of this invention. Accordingly, all such modifications and changes also fall within the scope of the appended claims and are intended to form part of this invention.

What is claimed is:

1. A decorative light set comprising:

a) a first plurality of lamp sockets interconnected by electrical conductors forming a first lamp string, each of the first plurality of lamp sockets having integral wings to grip the electrical conductors therein so as to form a netted lamp section having intersecting electrical conductors with a lamp socket at each intersection, the netted lamp section having a plurality of horizontal rows of lamp sockets, the lamp sockets in each row being horizontally spaced from the lamp sockets in an adjacent row; and, b) a second plurality of lamp sockets interconnected by electrical conductors, forming a plurality of linear arrays depending from a lowermost row of the plurality of horizontal rows of the netted lamp section, each linear array having a length, and being connected to adjacent linear arrays solely by the electrical conductors.

2. The decorative light set of claim 1 wherein the length of each linear array is different from the lengths of adjacent linear arrays.

3. The decorative light set of claim 1 further comprising:

a) a third plurality of lamp sockets interconnected by electrical conductors forming a second lamp string, the second lamp string located only in the netted lamp section; and, b) a control box connected to the first and second lamp strings to control operation of the first and second lamp strings.

4. The decorative light set of claim 3 wherein the second plurality of lamp sockets interconnected by electrical conductors comprises a third lamp string connected to the control box.

* * * * *